US005823707A

United States Patent [19]

Lodovico

[11] Patent Number: 5,823,707

[45] Date of Patent: Oct. 20, 1998

[54] SELF-PROPELLED REMOTE-CONTROLLED STONE CRUSHER DESIGNED TO OPERATE INSIDE TRENCHES

[75] Inventor: Laurini Lodovico, Busseto, Italy

[73] Assignee: Offcine Meccaniche Laurini Lodovico & C.S.N.C., Busseto, Italy

[21] Appl. No.: 751,112

[22] Filed: Nov. 15, 1996

[30] Foreign Application Priority Data

Jan. 29, 1996 [IT] Italy ..... PC96 A 0002

[51] Int. Cl.[6] ..... E01C 23/08; B02C 4/00; A01D 55/00; E21C 47/00

[52] U.S. Cl. ..... 404/91; 404/90; 241/33; 241/101.742; 299/39.2; 299/39.6

[58] Field of Search ..... 241/33, 101.742, 241/186.5; 404/90, 91; 299/30, 39.2, 39.6, 39.9

[56] References Cited

U.S. PATENT DOCUMENTS

| | | | |
|---|---|---|---|
| 2,148,022 | 2/1939 | Haaland | 241/186.5 |
| 2,787,943 | 4/1957 | Browning | 299/39.6 |
| 3,510,073 | 5/1970 | Mailliard | 241/101.742 |
| 3,916,605 | 11/1975 | Richards et al. | 241/101.742 |
| 4,417,627 | 11/1983 | Willibald | 241/101.742 |
| 4,616,880 | 10/1986 | Nozaki et al. | 299/93.2 |
| 4,753,484 | 6/1988 | Stolarczyk et al. | 299/1 |
| 5,664,907 | 9/1997 | Betsinger | 404/90 |

*Primary Examiner*—David J. Bagnell
*Assistant Examiner*—Gary S. Hartmann
*Attorney, Agent, or Firm*—Notaro & Michalos P.C.

[57] ABSTRACT

A self-propelled stone crusher includes systems designed to operate the various machine functions by remote control (30), for operating on open ground or inside trenches, collecting and crushing rocks and stones which are then unloaded and levelled behind the machine. The chassis (3) of the machine is hinged to a shaft (11) integral with a crawler support structure (5) so that the machine can be tilted to a greater or lesser extent, depending on the lie of the land, and the crusher has a hammer mill (10) at the front, the perimeter of which is formed by a grid consisting of a number of bars (25), the distance between which varies, depending on the required particle size of the crushed material.

10 Claims, 3 Drawing Sheets

SELF-PROPELLED REMOTE-CONTROLLED STONE CRUSHER DESIGNED TO OPERATE INSIDE TRENCHES

FIELD AND BACKGROUND OF THE INVENTION

This invention relates to a self-propelled remote-controlled stone crusher designed to operate on open ground or inside trenches, for collecting and crushing rocks and stones which are then unloaded and levelled behind the machine.

SUMMARY OF THE INVENTION

In accordance with the invention, the chassis of the machine is hinged to a shaft integral with the crawler support structure so that the machine can be tilted to a greater or lesser extent, depending on the lie of the land.

The crusher has a hammer mill at the front, the perimeter of which is formed by a grid consisting of a number of bars, the distance between which varies, depending on the required particle size of the crushed material.

The use of remote control devices eliminates the need for an operator on board the crusher in accordance with the invention. The invention thus, can be operated from a safe area so that the operator does not suffer the discomfort caused by the dust and noise generated during operations.

Crushing equipment used to crush rocks and stones on the ground, especially to prepare the base for laying pipelines and the like, is already known.

These machines are generally designed to operate inside a trench in which pipes will be laid, and usually consist of a crushing mill pulled by a tractor which is activated, via a suitable drive, by the tractor engine.

These stone crushers present various drawbacks, however, the main one being the need for the operator to remain on the tractor to control the machine during operations.

This involves considerable discomfort due to the level of noise generated during operations, which is reflected off the walls of the trenches, and to the dust raised.

There is also a degree of risk caused by rock and stone particles thrown up during milling and crushing.

In addition, the base prepared by these machines is not always even and level.

Basically, known stone crushers only offer partly satisfactory results.

For this reason, the need is felt in the industry for a machine which eliminates the difficulties mentioned above, and in particular for a self-propelled, preferably remote-controlled machine so that the operator need not remain on board but can operate the machine from a safe area well away from the noise and dust generated by the machine.

The crusher will preferably be fitted with systems designed to level the crushed material so as to produce a base ready for pipe laying.

This and other characteristics, which will be made clear in the detailed description that follows, are offered by a stone crusher in accordance with the characterising part of the claims.

BRIEF DESCRIPTION OF THE DRAWINGS

The description below refers to the annexed drawings, in which.

DESCRIPTION OF THE PREFERRED EMBODIMENT

Figure 1:
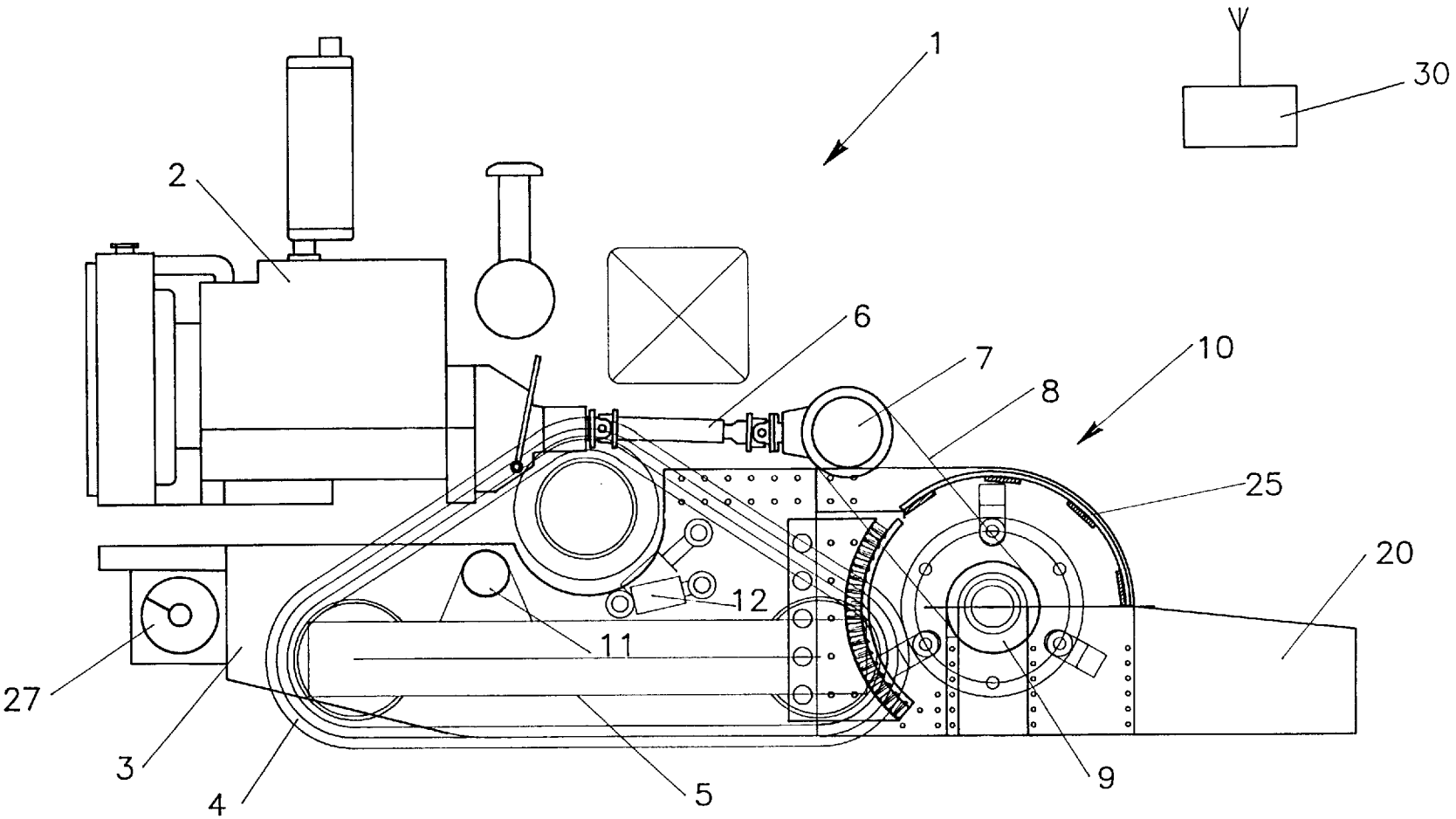
FIGS. 1 and 2 are schematic side views of a stone crusher in accordance with the invention, showing the chassis level and tilted respectively.

With reference to FIG. 1, the crusher in accordance with the invention comprises a self-propelled machine, the machine assembly being marked 1; the said machine is fitted with an engine 2, mounted on a chassis 3, which drives a pair of crawlers 4.

The support structure of the crawlers is marked 5.

A drive shaft 6 transmits motion from engine 2 to a differential 7 and from there, via a number of belts 8 fitted on sheaves 9, to a hammer crushing or milling device, the assembly of which is marked 10.

In accordance with the invention, the various machine drive and control devices are connected to remote controls 30 such as a radio control, which is not illustrated in detail as it is of known type.

Crusher chassis 3 is pivotally connected to a basically horizontal chassis support shaft 11, the ends of which are fitted to support structure 5 of crawlers 4.

In this way the chassis, and the machine with it, tilts around the axis of shaft 11, thus enabling the machine to be inclined in relation to the surface on which the crawlers rest so that it can work on slopes.

The inclination of chassis 3 in relation to the crawler structure is controlled by a pair of pistons 12, whose elongation causes a corresponding variation in the inclination of chassis 3.

Figure 4:
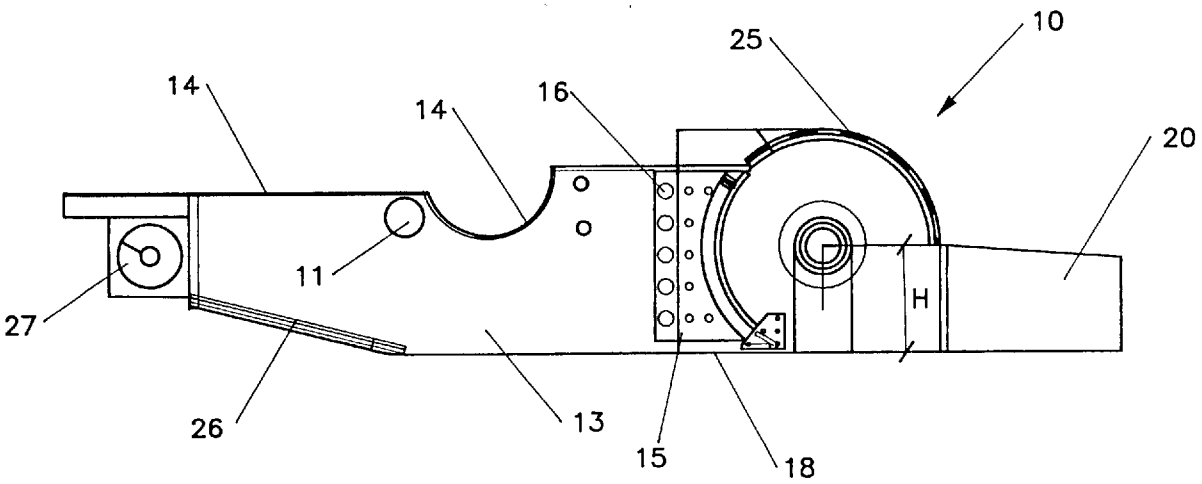
FIGS. 4 and 5 illustrate the devices which support the crushing mill and connect it to the machine, shown assembled and in exploded view respectively.
Figure 5:
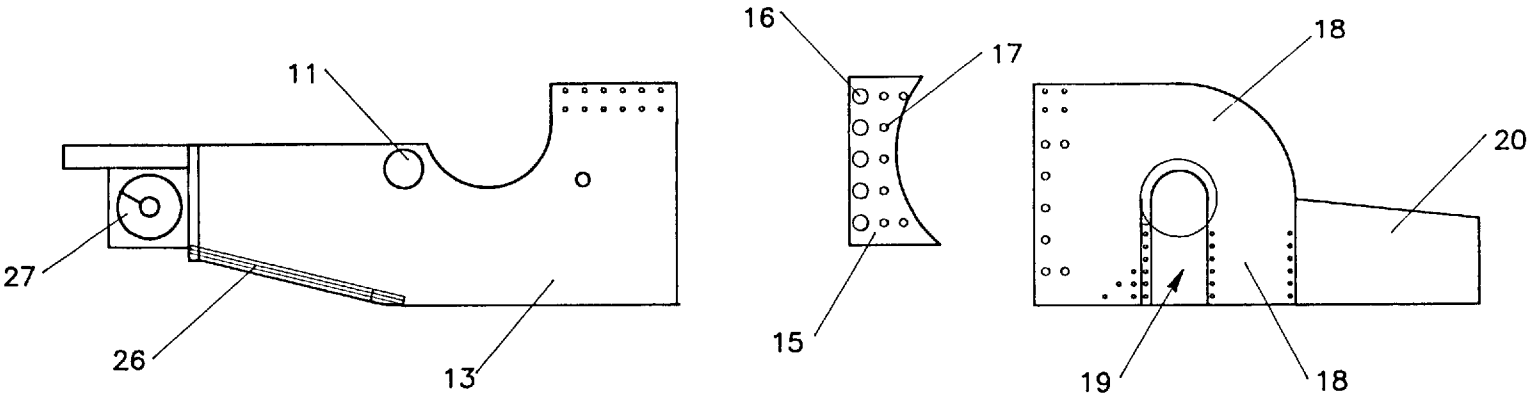

The structure on which the crawlers are fitted comprises a pair of side walls 13, illustrated in FIG. 4, to which shaft 11 is welded; these walls are connected at the top to a sheet metal wall 14, which also constitutes the surface on which the engine and the other devices present on the machine rest.

Two gusset plates 15, made of sheet metal of suitable thickness, are welded to the front of walls 13; these gusset plates contain a number of openings 16 around the edges of which welding is performed, and a set of holes 17 through which the same number of bolts pass to secure the parts constituting the conveyor and the mill support.

These comprise a pair of walls 18 which contain an opening 19 so that the mill shaft can be removed with no need to extract it axially, and a pair of side walls 20, bolted to walls 18, which constitute the actual walls of the conveyor and secure the bottom of the mill shaft to retain it in its seating.

Walls 20 serve to guide and convey rocks and stones to the crushing mill.

Figure 3:
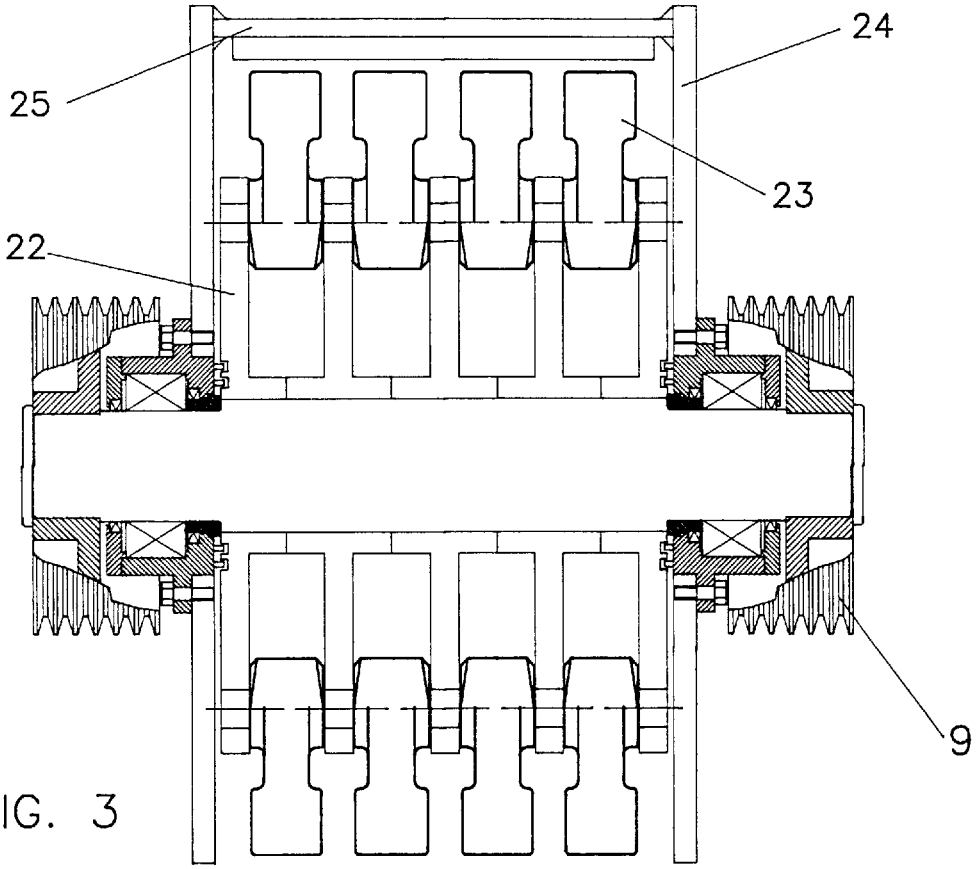
FIG. 3 is a cross-section of the stone crushing devices of a machine in accordance with the invention.
Figure 2:
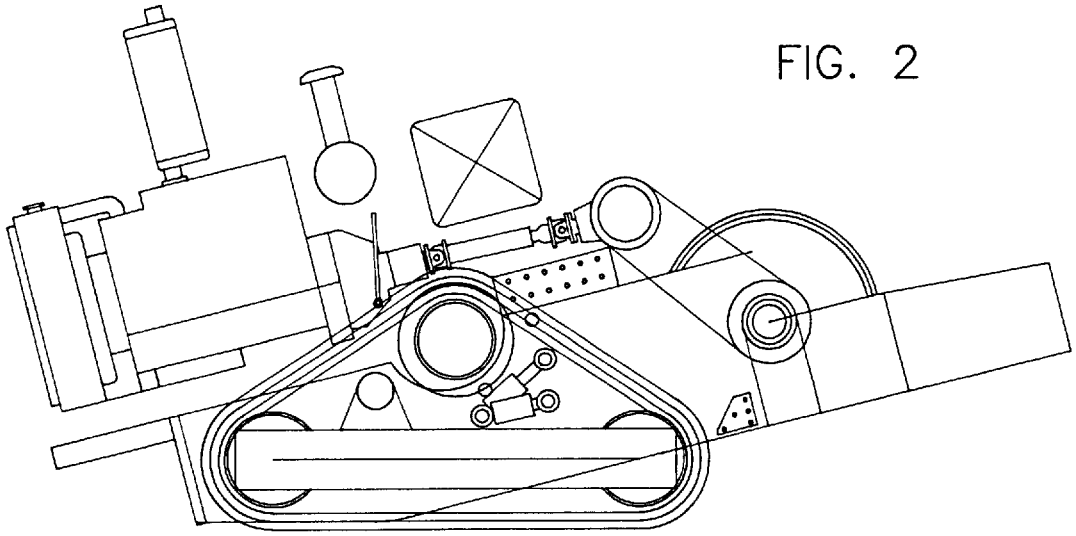

The latter, illustrated in cross section in FIG. 3, is mounted on a shaft made to rotate by belts 8, fitted on pulleys 9. A number of discs 22, to which a number of hammers 23 are hinged, are integral with the shaft.

At the perimeter, a number of bars 25 of suitable thickness are fixed to mill walls 24; these bars act as strikers for the hammers, which crush the stones against them.

The distance between the bars is determined on the basis of the required particle size of the crushed material.

At the front (in the direction of travel of the machine), bars 25 are missing for a section, indicated by the letter H in FIG. 4, to form an opening through which stones enter the crushing mill.

The crushed stones exit from the back of the mill, through the grid constituted by the set of bars 25, and fall to the ground, where they are collected as the machine advances by an inclined plate 26 fixed to the back of side walls 13.

Plate 26 slides forward on contact with the soil and the rear part is raised, so that the stones fall from a certain height in order to level the crushed material to some degree in the bottom of the trench.

Alternatively, if the machine is to be used to fill the trench, a screw conveyor 27 could be fitted behind plate 26 to collect the stones from plate 26 and unload them at the side, inside the trench.

The operation of the machine in accordance with the invention will be clear from the description given.

The operator, who stands at the edge of the trench, at a safe distance, uses a radio control to operate the machine, which travels along the bottom of the trench.

The engine, via shaft 6, differential 7 and belts 8, causes mill 10 to rotate.

The stones enter the mill through front opening H as the machine moves to the right in FIG. 1 by motion of crawlers 4, and are crushed by hammers 23 against bars 25. The stones are guided into opening H since they move between walls 20 as the machine moves forward.

When the stones have been crushed to a size smaller than the distance between bars 25, they exit behind the mill, from the grid which constitutes its perimeter wall.

As the machine advances, the stones are collected by inclined wall 26 and unloaded again onto the bottom of the trench; they are dropped from a certain height in order to achieve a better degree of levelling.

If the machine is used to fill a trench after pipes have been laid, a screw conveyor 27 will be fitted to collect the stones from inclined wall 26 and unload them at the side, into the trench.

If the machine has to operate on a slope, it will be sufficient for the operator to activate pistons 12 to rotate the machine chassis around shaft 11, thus giving the machine the same inclination as the work surface.

For the purpose of repair and maintenance operations it is sufficient to dismantle the assembly constituted by walls 18 and 20 and mill 10 by simply removing the bolts which fix plates 18 to gusset plates 17.

To dismantle the mill, it is sufficient to remove side walls 20 in order to clear opening 19, through which the mill shaft can be extracted.

An expert in the field could devise numerous modifications and variations, all of which should be considered to fall within the scope of this invention.

I claim:

1. A self-propelled stone crusher comprising:

a machine chassis (3);

an engine unit (2) fixed to and moveable with said machine chassis;

a stone crushing mill (10) fixed to and moveable with said chassis, said stone crushing mill being connected to said engine unit for crushing stones introduced into said mill;

a crawler support structure (5);

a chassis support shaft (11) connected to and supported by said crawler support structure;

a crawler (4) moveably mounted to said crawler support structure and operatively connected to said engine unit for driving said crawler support structure with said horizontal shaft in a forward direction;

said chassis (3) being pivotally mounted to said chassis support shaft for moving in the forward direction with said crawler support structure; and inclination control means (12) connected between said crawler support structure and said chassis for controlling an inclination of said chassis with respect to said crawler support structure by pivoting said chassis on said chassis support shaft and thereby controlling an inclination of said crushing mill with respect to said crawler support structure and with respect to said crawler while said crawler moves said chassis in the forward direction.

2. A stone crusher according to claim 1 including a remote control for remotely operating said engine unit.

3. A stone crusher according to claim 2 wherein said stone crushing mill comprises a cage having an inlet opening (H) for receiving stones as the chassis moves in the forward direction, the cage with outlet openings for discharging stones that are crushed and a plurality of hammers (23) rotatable in said cage for crushing stones and moving crushed stones through outlet openings in said cage.

4. A stone crusher according to claim 3 wherein said chassis includes forward side walls (20) on opposite sides of said inlet opening in said cage for guiding stones into said stone crushing mill when said chassis moves in the forward direction.

5. A stone crusher according to claim 3 wherein said chassis includes a lower inclined plate (26) which is inclined with respect to a bottom of said chassis and which is behind said stone crushing mill with respect to the forward direction for scooping up crushed stones discharge through said outlet openings in said cage from said stone crushing mill as said chassis moves in the forward direction.

6. A stone crusher according to claim 5 wherein said inclined plate has a forward end with respect to the forward direction which is lower than a rear end of said inclined plate when said chassis is horizontal, for raising crushed stones upwardly alone said inclined plate and allowing them to fall from the rear end of the inclined plate as the chassis moves in the forward direction.

7. A stone crusher according to claim 6 including a conveyer (27) connected to said chassis rearwardly of said inclined plate for conveying crushed stones transversely to the forward direction as crushed stones are received from the rear end of said inclined plate as said chassis moves in the forward direction.

8. A stone crusher according to claim 7 wherein said conveyer comprises a screw conveyer.

9. A stone crusher according to claim 1 wherein said stone crushing mill comprises a milling shaft rotatable to crushed stones introduced into said stone crushing mill with movement of the chassis in the forward direction, said chassis comprising a pair of front side walls (18) each having a slit (19) for removably receiving said milling shaft without requiring axial movement of said milling shaft.

10. A stone crusher according to claim 9 wherein said chassis includes a pair of removable supports (17) removably connected to said front side walls, said chassis including a pair of rear side walls (13) positioned rearwardly of said front side walls with respect to the forward direction, said support (17) being welded to said rear side walls (13), said rear side walls being pivotally connected to said chassis support shaft (11).

* * * * *